US011614713B2

(12) United States Patent
Kuroda et al.

(10) Patent No.: US 11,614,713 B2
(45) Date of Patent: Mar. 28, 2023

(54) TIMEPIECE

(71) Applicant: CITIZEN WATCH CO., LTD., Tokyo (JP)

(72) Inventors: Akihiko Kuroda, Saitama (JP); Kazuki Tada, Saitama (JP); Yuya Matsushita, Tokyo (JP); Setsuo Kachi, Tokyo (JP)

(73) Assignee: CITIZEN WATCH CO., LTD., Tokyo (JP)

( * ) Notice: Subject to any disclaimer, the term of this patent is extended or adjusted under 35 U.S.C. 154(b) by 517 days.

(21) Appl. No.: 16/724,168

(22) Filed: Dec. 20, 2019

(65) Prior Publication Data

US 2020/0201257 A1 Jun. 25, 2020

(30) Foreign Application Priority Data

Dec. 25, 2018 (JP) ..... JP2018-241742
Aug. 13, 2019 (JP) ..... JP2019-148559

(51) Int. Cl.
*G04B 19/06* (2006.01)
*G04B 19/04* (2006.01)
*G04B 19/12* (2006.01)

(52) U.S. Cl.
CPC ..... *G04B 19/065* (2013.01); *G04B 19/04* (2013.01); *G04B 19/12* (2013.01)

(58) Field of Classification Search
CPC ..... G04B 19/12; G04B 19/065; G04B 19/04; G04B 19/06
See application file for complete search history.

(56) References Cited

U.S. PATENT DOCUMENTS 6,466,522 B1 * 10/2002 Yoshioka ..... G04B 19/32 368/205
8,976,630 B2 * 3/2015 Oshio ..... G04B 19/12 368/80
2009/0080294 A1 3/2009 Arita et al.
2013/0051192 A1 2/2013 Oshio

FOREIGN PATENT DOCUMENTS

JP H03-070389 U 7/1991
JP H04-066597 U 6/1992
JP 2001-159875 A 6/2001
JP 2009-074880 A 4/2009
JP 2009-250674 A 10/2009
(Continued)

OTHER PUBLICATIONS

Japan Patent Office, Office Action for Japanese Patent Application No. 2019-148559, dated Feb. 7, 2023.

*Primary Examiner* — Sean Kayes

(57) ABSTRACT

Provided is a timepiece including: hands being an hour hand, a minute hand and a second hand; a movement for driving the hands; a first dial; a first dial ring having upper and lower surfaces provided with an upper projection and a lower projection, respectively, the first dial ring being disposed on the first dial and positioned relative to the first dial by the lower projection; and a transparent second dial disposed on the first dial ring and positioned relative to the first dial ring by the upper projection, wherein one of the hands is disposed between the first dial and the second dial, while the others of the hands are disposed above the second dial.

7 Claims, 13 Drawing Sheets

(56) References Cited

FOREIGN PATENT DOCUMENTS

| | | | |
|---|---|---|---|
| JP | 4595977 | B2 | 12/2010 |
| JP | 2011-149880 | A | 8/2011 |
| JP | 2013-050419 | A | 3/2013 |
| JP | 2014-215050 | A | 11/2014 |
| JP | 5853504 | B2 | 2/2016 |
| JP | 2018-128443 | A | 8/2018 |

* cited by examiner

FIG. 6A
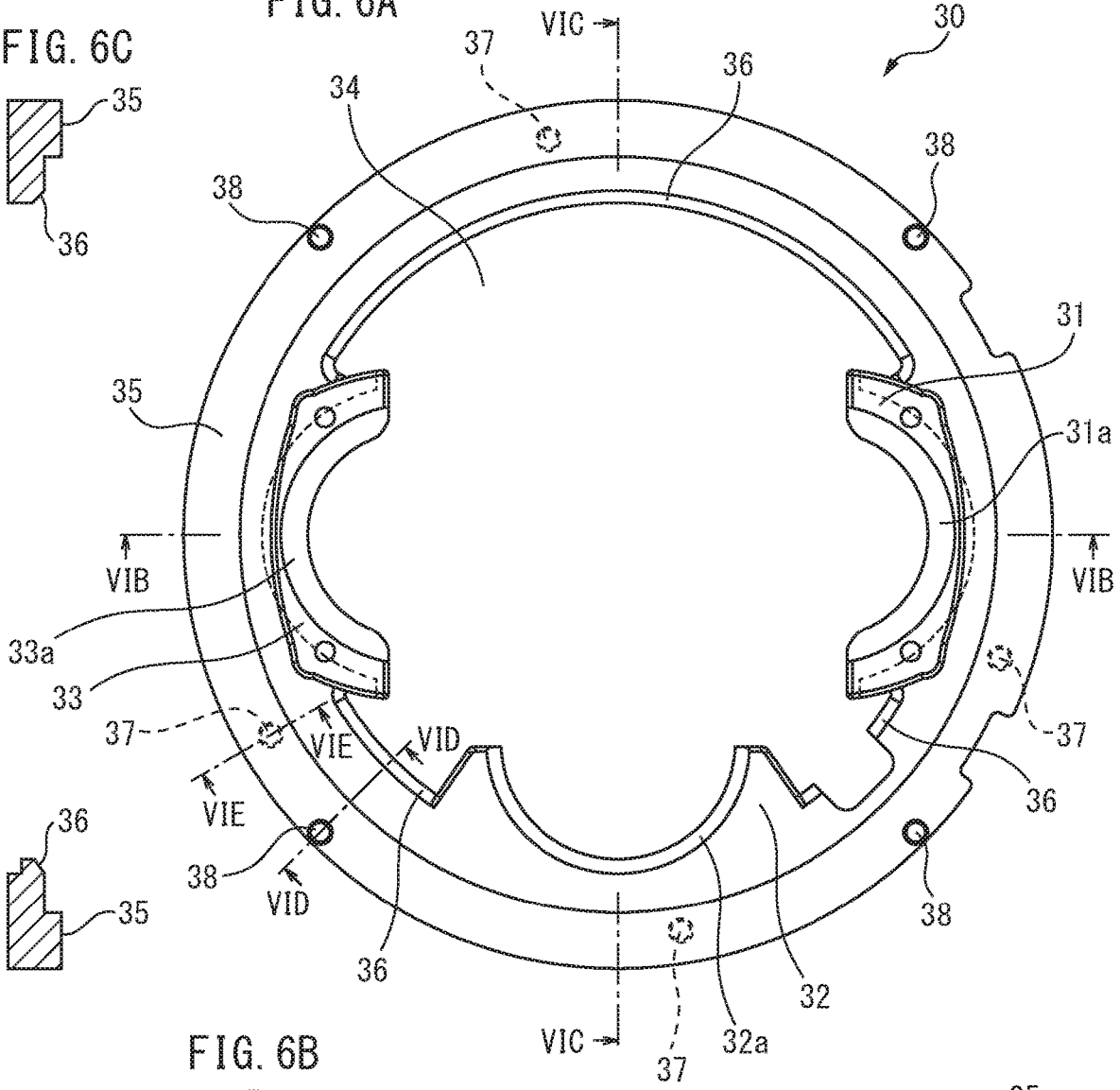
FIG. 6C
FIG. 6B
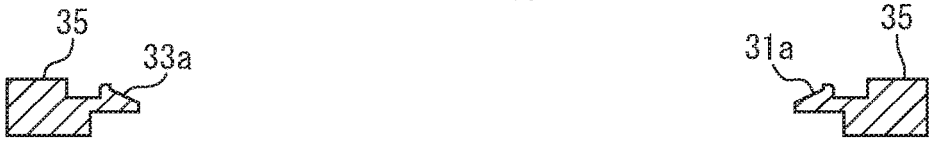
FIG. 6D
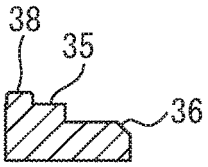
FIG. 6E
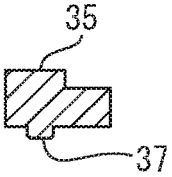

TIMEPIECE

CROSS REFERENCE TO RELATED APPLICATION

This application claims the benefit of Japanese Patent Application JP2018-241742 and JP2019-148559 filed on Dec. 25, 2018 and Aug. 13, 2019, respectively. The disclosure of JP2018-241742 and JP2019-148559 is herein incorporated by reference.

FIELD

The present invention relates to a timepiece.

BACKGROUND

Japanese Patent No. 4595977 describes a twofold dial including an upper dial having an opening, hands (pointers) moving above the upper dial, a lower dial disposed below the upper dial, a viewing frame provided between the upper and lower dials at a position corresponding to the opening of the upper dial, and an auxiliary hand capable of moving in the viewing frame, wherein the viewing frame and lower dial include position restricting parts for positioning the viewing frame relative to the lower dial.

Japanese Patent No. 5853504 describes a dial assembly housed in a timepiece case, the dial assembly including a ring member, a first dial, a ring-shaped spacer and a second dial in sequence, and further including a restricting means for restricting the positional relationship between the first and second dials, the spacer and a movement.

SUMMARY

Multifunctional timepieces need to show various kinds of information. However, disposing characters and indices corresponding to those kinds of information on a dial makes the dial surface complicated and reduces the visibility of time indications. In order to make indices related to times particularly conspicuous, a transparent second dial having the indices thereon may be provided above a first dial and supported by a dial ring. Since combining the second dial and the dial ring into a single component makes its manufacturing process complicated, they should be separate components; in this case, the second dial needs to be reliably positioned and fixed relative to the dial ring. Further, since two superposed dials makes the timepiece thicker, creative design is required in order to reduce overall thickness.

It is an object of the present invention to provide a timepiece which is excellent in visibility of time indications, reduced in overall thickness and has a dial and a dial ring easily positioned relative to each other.

Provided is a timepiece including: hands being an hour hand, a minute hand and a second hand; a movement for driving the hands; a first dial; a first dial ring having upper and lower surfaces provided with an upper projection and a lower projection, respectively, the first dial ring being disposed on the first dial and positioned relative to the first dial by the lower projection; and a transparent second dial disposed on the first dial ring and positioned relative to the first dial ring by the upper projection, wherein one of the hands is disposed between the first dial and the second dial, while the others of the hands are disposed above the second dial.

Preferably, the hour hand is disposed between the first dial and the second dial, while the minute hand and the second hand are disposed above the second dial. Also preferably, the first dial is positioned relative to the movement by a fit between projections and depressions.

Preferably, the timepiece further includes a second dial ring disposed on the second dial so as to cover the upper projection, the second dial ring being positioned relative to the second dial by a fit between projections and depressions.

Preferably, the timepiece further includes: a third dial ring having an inner circumferential surface in contact with an outer circumferential surface of the second dial ring, the third dial ring having a first scale on its upper surface and having a gear along its circumference; and a crown fitted to the gear and configured to be operated by a user to rotate the third dial ring, wherein the second dial ring has a second scale on its upper surface, the second scale functioning as a circular slide rule in combination with the first scale.

Preferably, the timepiece further includes a small hand for indicating information other than a time indicated by the hands, wherein the small hand is driven by the movement and displaced from the hands in a thickness direction of the timepiece between the first dial and the second dial.

Preferably, the second dial has a central opening through which the hands are visible from above the second dial.

Preferably, the second dial has indices for indicating a time, the indices being composed of a mixture of a resin and decorative particles. Also preferably, the decorative particles are particles of a noctilucent inorganic compound.

BRIEF DESCRIPTION OF PIE DRAWINGS

Other features and advantages of the present invention will be apparent from the ensuing description, taken in conjunction with the accompanying drawings, in which:

FIGS. 6A to 6E are a top view and cross-sectional views of the first dial ring 30;

Figure 12B:
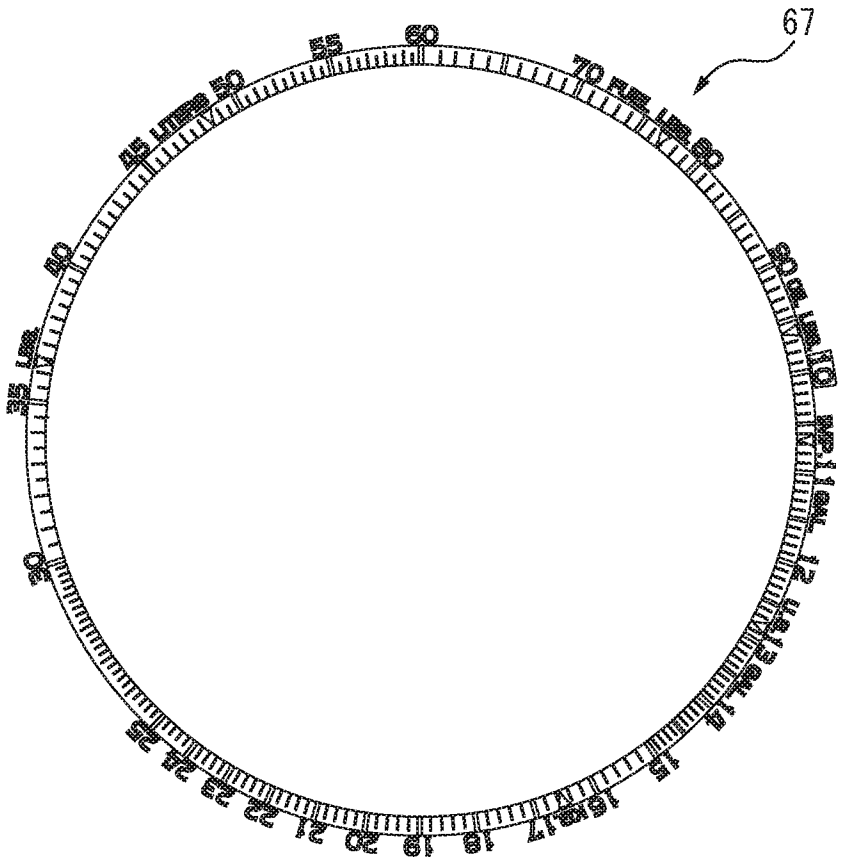
Figure 12A:
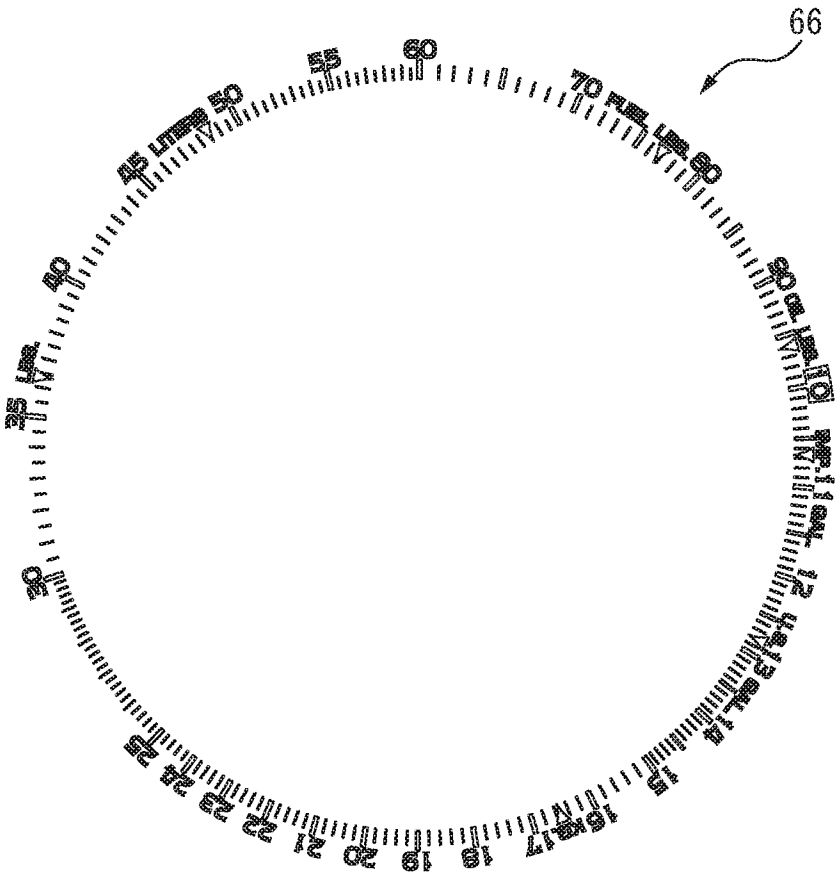
Figure 13A:
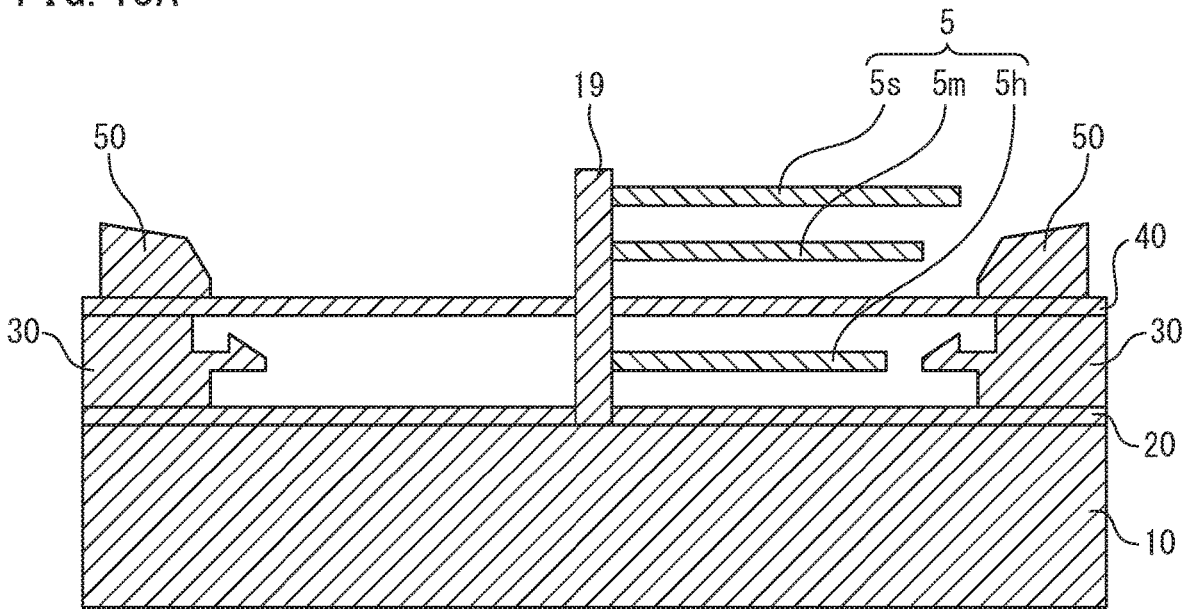
Figure 13B:
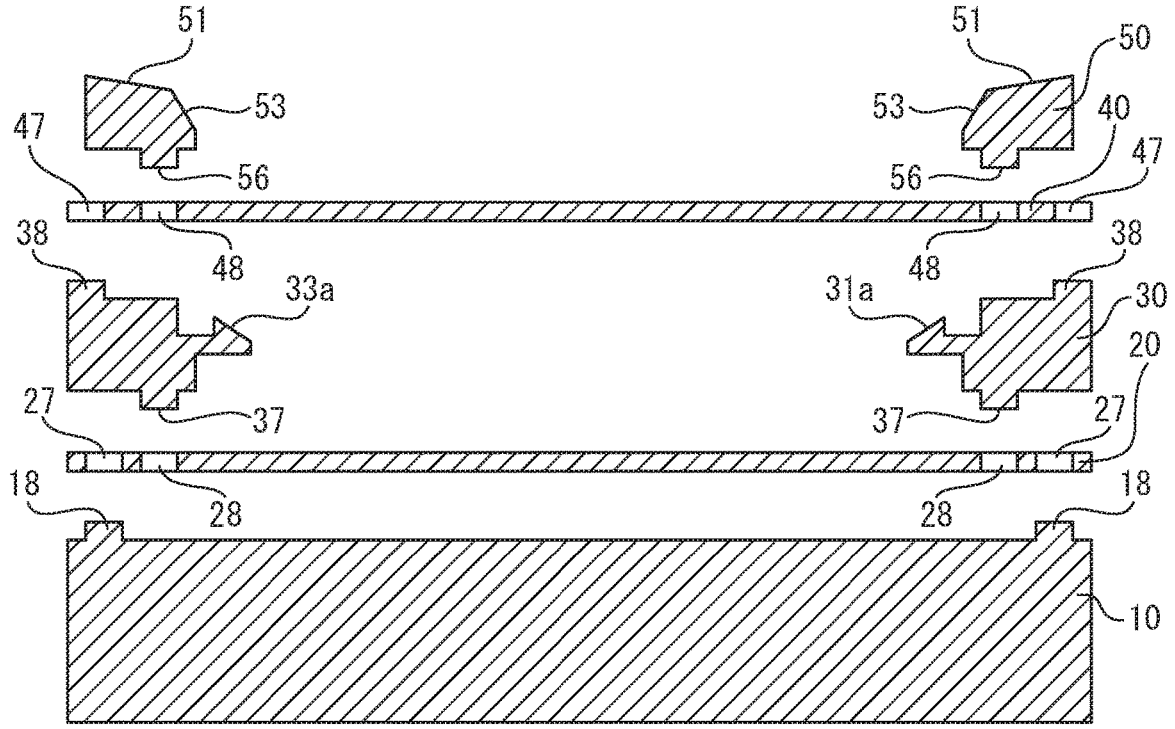

FIGS. 12A and 12B shows scales 66, 67 of the rotating dial ring 60 and another rotating dial ring; and FIGS. 13A and 13B are schematic cross-sectional views for explaining the connection relationship between the movement 10, first dial 20, first dial ring 30, second dial 40 and second dial ring 50.

DESCRIPTION OF EMBODIMENTS

Hereinafter, with reference to the accompanying drawings, a timepiece will be explained in detail. However, note that the present invention is not limited to the drawings or the embodiments described below.

Figure 1:
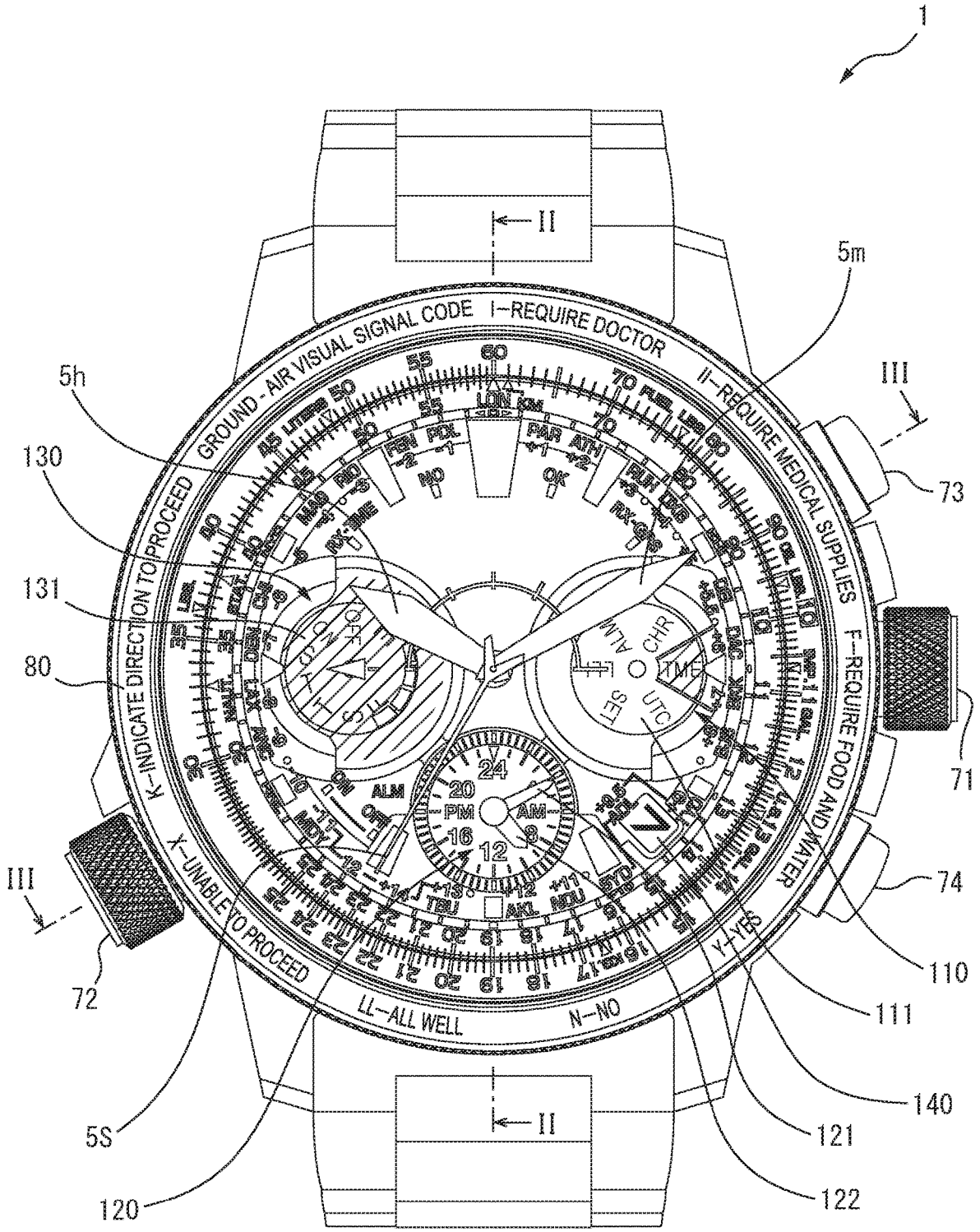
FIG. 1 is a top view of a timepiece 1.
Figure 2:
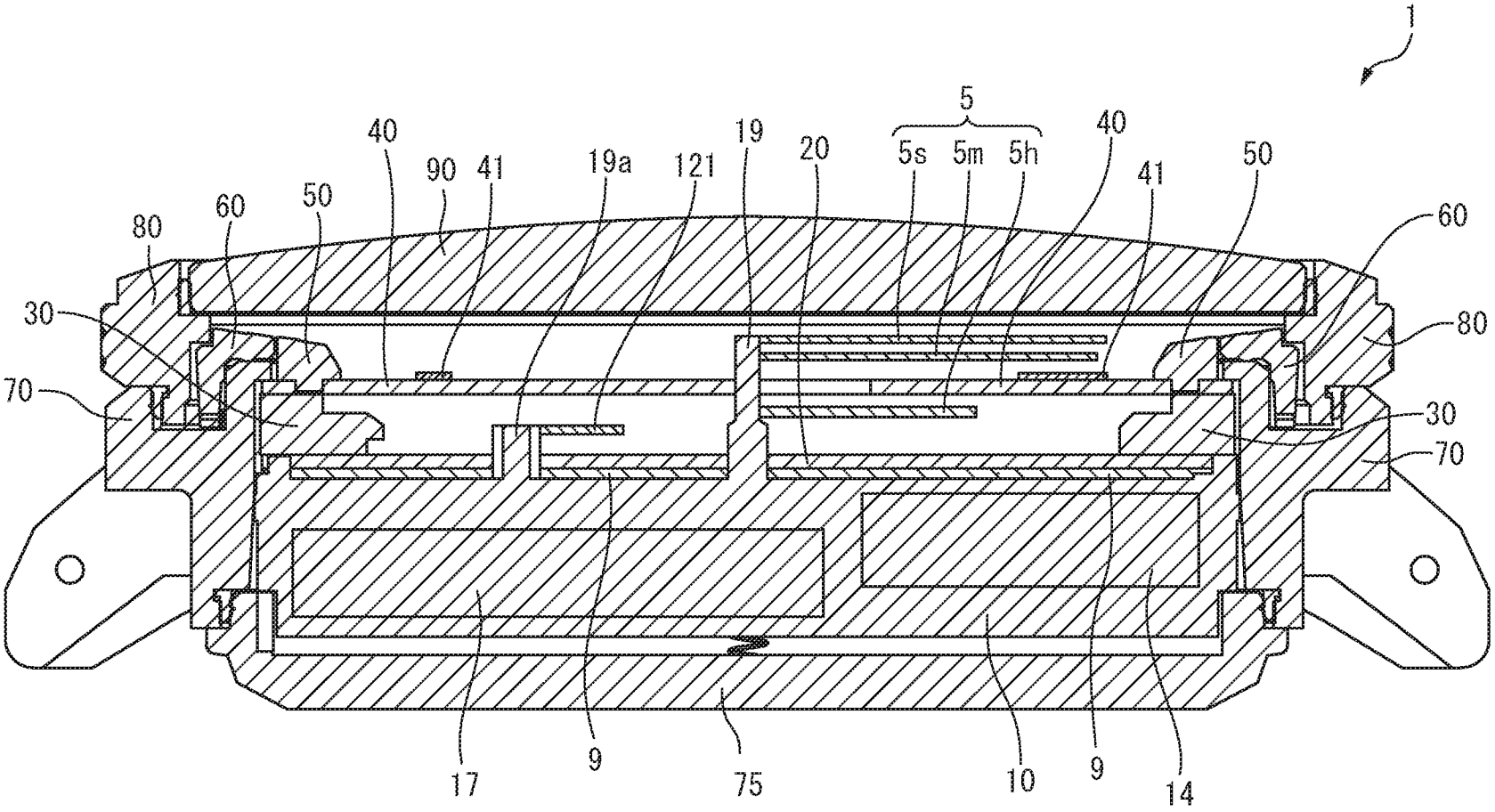
FIGS. 2 and 3 are cross-sectional views of the timepiece 1.
Figure 3:
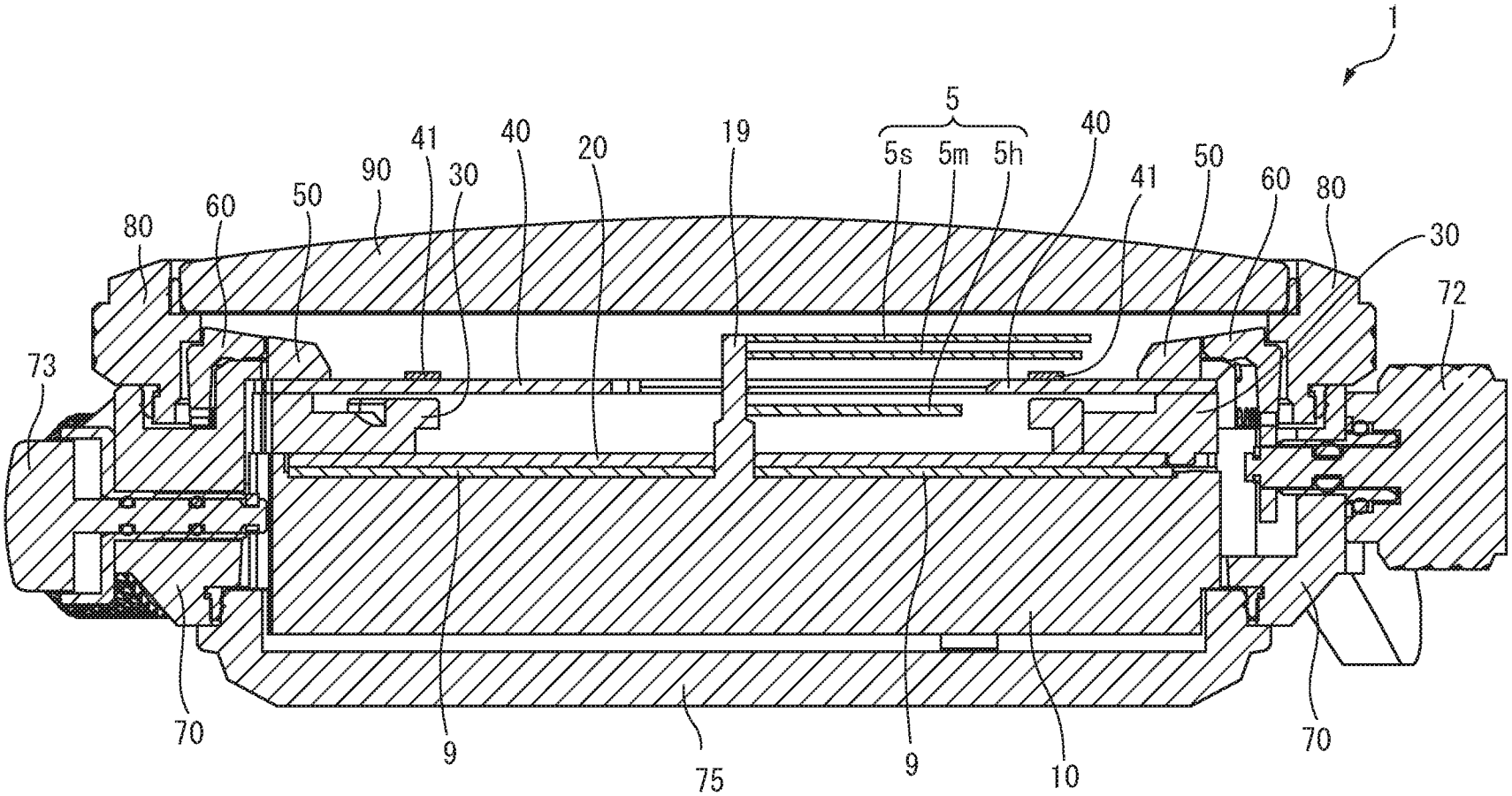

FIG. 1 is a top view of a timepiece 1, while FIGS. 2 and 3 are cross-sectional views of the timepiece 1. FIGS. 2 and 3 show cross sections of the timepiece 1 taken along lines II-II and III-III of FIG. 1, respectively. Major components of the timepiece 1 include hands 5, a solar cell 9, a movement 10, a first dial 20, a first dial ring 30, a second dial 40, a second dial ring 50, a rotating dial ring 60, an outer case 70, a case back 75, a bezel 80 and a protective glass 90. The first dial ring 30, second dial ring 50 and rotating dial ring 60 are annular members. As shown in FIG. 1, on the side surface of the outer case 70, a first crown 71, a second crown 72 and operation buttons 73, 74 are disposed at the 3-o'clock, 8-o'clock, 2-o'clock and 4-o'clock positions, respectively.

The timepiece 1 is a model designed for an aircraft pilot, in particular. As shown in FIG. 1, character strings indicating ground-air visual signal codes, i.e., "I-REQUIRE DOCTOR," "II-REQUIRE MEDICAL SUPPLIES," "F-REQUIRE FOOD AND WATER," "Y-Yes," "N-No," "LL-All WELL," "X-UNABLE TO PROCEED" and "K-INDICATE DIRECTION TO PROCEED" are sequentially printed on the upper surface of the cylindrical bezel 80 clockwise from the 12-o'clock position.

Scales functioning as an aviation slide rule (circular slide rule) are formed on the upper surfaces of the rotating dial ring 60 and second dial ring 50, which are disposed inside the bezel 80 and rotating dial ring 60, respectively. The scale of the rotating dial ring 60 is rotated by a user winding the second crown 72. The aviation slide rule will be described later with reference to FIGS. 10 and 12A.

The hands 5 are an hour hand 5*h*, a minute hand 5*m* and a second hand 5*s*, and rotate clockwise around a rotating shaft 19 provided at the center of the first dial 20 to indicate the current time (hour, minute and second). The shapes of the hands 5 should be substantially stick-like, but may be appropriately changed, depending on the design of the timepiece.

As shown in FIG. 1, the timepiece 1 includes a first indicator 110, a second indicator 120, a third indicator 130 and a fourth indicator 140 at the 3-o'clock, 6-o'clock, 9-o'clock and half-4 positions on the first dial 20. These indicators are disposed closer to the center of the first dial 20 than the scales of the aviation slide rule (more specifically, closer than the first dial ring 30, second dial ring 50 and rotating dial ring 60).

The first indicator 110 indicates the mode of the timepiece 1 with an indication disk 111. On the upper surface of the indication disk 111, character strings (marks) "CHR," "TME," "UTC," "SET," "LLI" and "ALM" are printed at intervals of 60 degrees. These marks correspond to functions of a chronograph (stopwatch), normal time indication, indicating Coordinated Universal Time, changing setting (e.g., setting the time), indicating light quantity of the timepiece, and setting an alarm, respectively. The indication disk 111 is rotated around a rotating shaft provided at the center of the first indicator 110, by a user pulling and winding the first crown 71. In the timepiece 1, the triangular index at the 3-o'clock position also serves as the index of the first indicator 110. When a user aligns a mark corresponding to a desired mode with the 3-o'clock position, the function corresponding to that mark will be performed.

The second indicator 120 indicates, for example, the current time (local time) of a city located in a time zone different from the city where the user resides, with small hands 121, 122. The small hands 121, 122 are a minute and hour hands, respectively, and rotate clockwise around a rotating shaft 19*a* (see FIG. 2) provided at the center of the second indicator 120. Since the second indicator 120 is a 24-hour clock, the 6-o'clock and 12-o'clock positions of a normal timepiece correspond to 12 o'clock and 24 o'clock, respectively, and the small hand 122 makes one revolution every 24 hours in the second indicator 120.

The third indicator 130 indicates information on ON/OFF of daylight-saving-time indication, the day of the week, and the amount of charge of a battery (secondary cell 17 in FIG. 4 described later), with an indication disk 131. On the upper surface of the indication disk 131, characters "ON" and "OFF" for daylight saving time, characters "S" (Sunday), . . . , "T" (Tuesday), "T" (Thursday), "S" (Saturday), and markings of "F" (full) to "E" (empty) indicating the amount of charge are circularly provided in sequence. The indication disk 131 is rotated around a rotating shaft provided at the center of the third indicator 130, by a user pulling the first crown 71 and pushing the operation button 73 or 74, for example. In the timepiece 1, the triangular index at the 9-o'clock position and a triangular mark (mark 44 in FIG. 8A described later) facing that index correspond to the indices of the third indicator 130.

When the indication disk 131 indicates the day of the week, one of the characters "S," "T," "T," "S" corresponding to the current day of the week is disposed at the 9-o'clock position. If a user desires indication of daylight saving time, he/she pulls the first crown 71 and pushes the operation button 73 or 74, for example, and then every push rotates the characters "ON" and "OFF" alternately to the 9o'clock position. Setting "ON" at the 9o'clock position causes the hands 5 to indicate the daylight saving time, while setting "OFF" there causes them to indicate the standard time. If a user desires indication of the amount of charge, he/she pushes the operation button 73 or 74 without pulling the first crown 71, for example, and then one of the markings of "F" to "E" corresponding to the amount of charge rotates to the 9o'clock position.

The fourth indicator 140 is a window for showing the date, and shows one of numerals provided on a date dial (not shown). The date dial is a disk-shaped member provided with numerals "1" to "31" circularly in sequence, and is disposed below the first dial 20 and makes one revolution every month. In the illustrated example, the fourth indicator 140 shows "7" indicating the seventh day.

Figure 4:
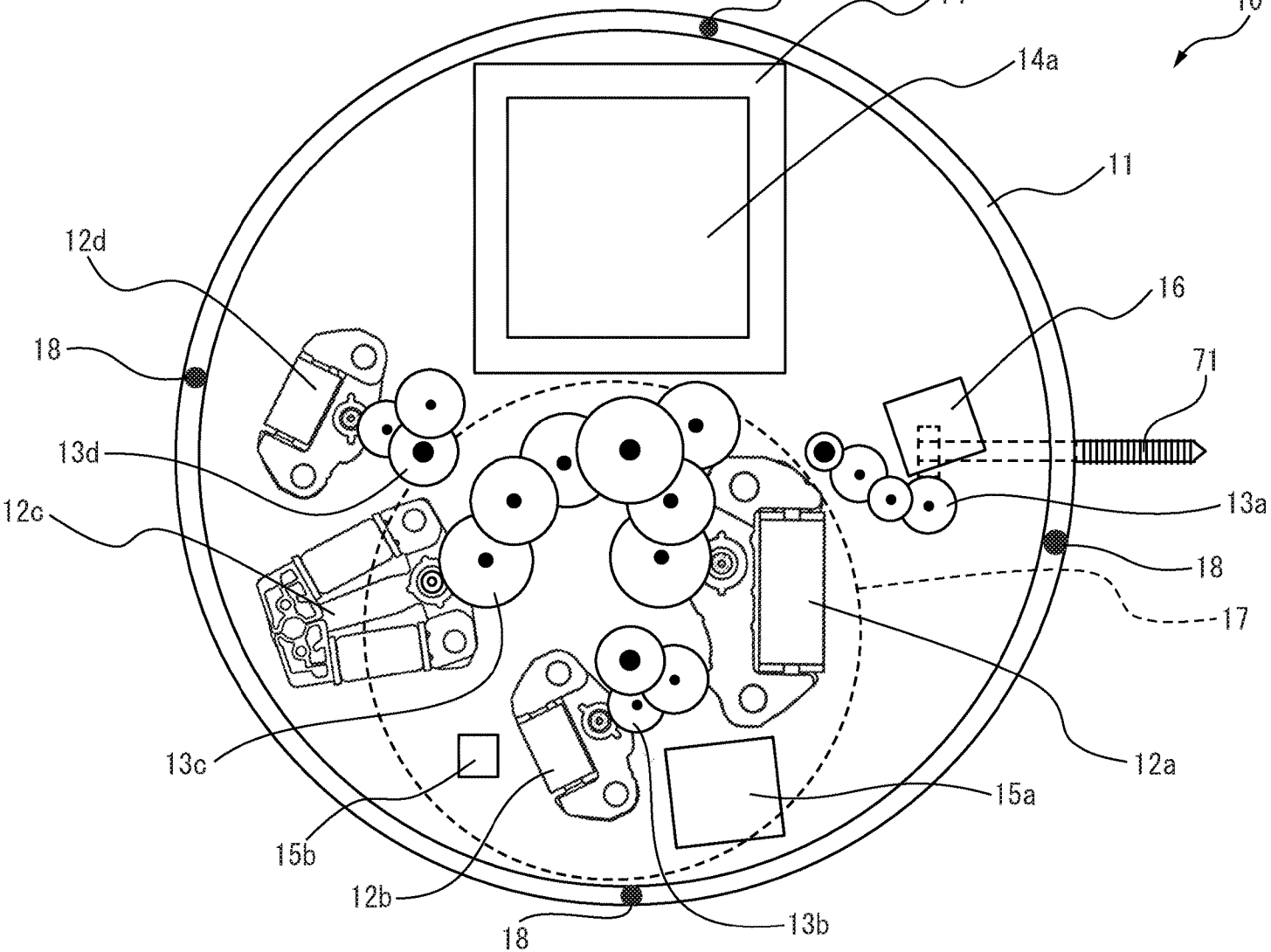
FIG. 4 is a schematic top view of the movement 10.

FIG. 4 is a schematic top view of the movement 10. The movement 10 is a driving mechanism of the timepiece 1 including mechanical and electrical components, and drives the rotating shafts 19, 19*a* of the hands 5 and small hands 121, 122. The movement 10 includes a circular frame 11 disposed close to the case back 75 in the outer case 70, and components disposed inside the frame 11, such as motors 12*a* to 12*d*, gear trains 13*a* to 13*d*, an antenna 14, timepiece control ICs 15*a*, 15*b*, a communication control IC 16 and a secondary cell 17. On the circumference of the frame 11, four projections 18 fitted into recesses (recesses 27 in FIG. 5 described later) of the first dial 20 are formed at intervals of about 90 degrees.

The motors 12*a* to 12*d* are stepper motors driving the hands 5, small hands 121, 122 and indication disk 131. The motor 12*a* rotates the hour hand 5*h* and minute hand 5*m* in an interlocked manner, and the motor 12*b* similarly rotates the small hands 121, 122. The motors 12*c*, 12*d* rotate the second hand 5*s* and indication disk 131, respectively. The gear train 13*a* links the first crown 71 with the rotating shaft of the indication disk 111, while the gear train 13*b* links the rotating shaft 19*a* of the small hands 121, 122 with the motor 12*b*. The gear train 13*c* links the rotating shaft 19 of the hands 5 with the motors 12*a*, 12*c*, while the gear train 13*d* links the rotating shaft of the indication disk 131 with the motor 12*d*. Unlike the illustrated example, all the hands may be independently rotated by separate motors.

The antenna 14 is a rectangular member disposed so as to cover the area around the 12-o'clock position in the frame 11, and receives satellite signals (e.g., signals of the global positioning system (GPS)), standard time and frequency signals or other radio signals with a rectangular antenna electrode 14*a*. The timepiece control ICs 15*a*, 15*b* are electronic components for controlling the motors 12*a* to 12*d* driving the hands 5 and other components. The communication control IC 16 is an electronic component for controlling receiving operation by the antenna 14 and processing the received signals. These ICs are mounted on a circuit board (not shown) disposed in the frame 11. Although the timepiece 1 is a radio-controlled watch capable of receiving time information with the antenna 14 and setting the current time, the antenna 14 and communication control IC 16 are not necessary components, and the function of receiving radio signals (communication function) may be omitted.

The secondary cell 17 is a battery which can be recharged by the solar cell 9 disposed between the first dial 20 and movement 10, and supplies electric power to the motors 12*a* to 12*d*, timepiece control ICs 15*a*, 15*b* and communication control IC 16. In FIG. 4, the position of the secondary cell 17 is indicated by a broken line, since it is disposed so as to cover the motors 12*a* to 12*c*, gear trains 13*b*, 13*c* and timepiece control ICs 15*a*, 15*b* in the timepiece 1. Instead of the secondary cell 17, a primary cell may be used as the power source of the timepiece 1; in this case, the solar cell 9 may be omitted.

Figure 5:
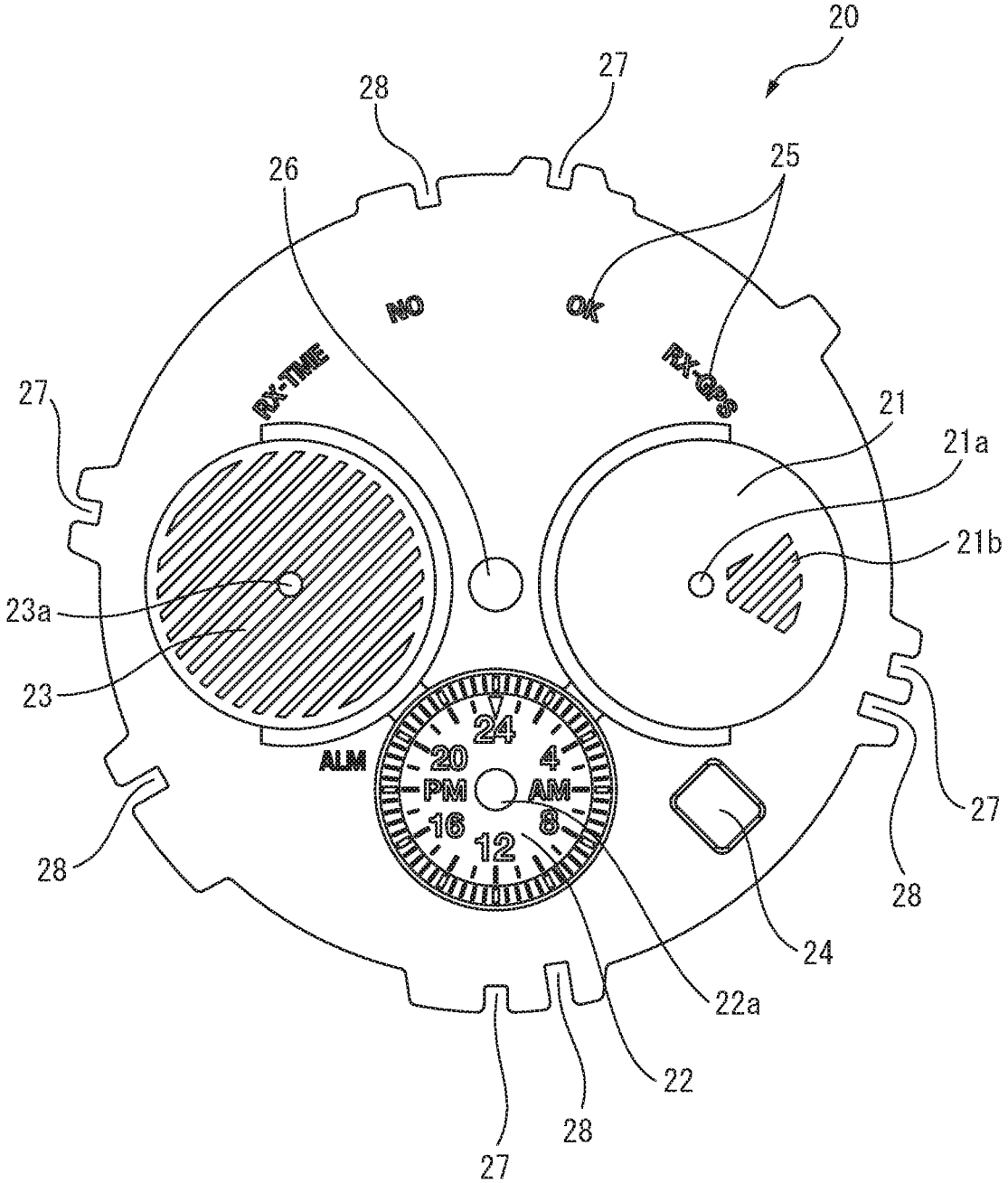
FIG. 5 is a top view of the first dial 20.

FIG. 5 is a top view of the first dial 20. The first dial 20 is a substantially disk-shaped member disposed above the movement 10 (and solar cell 9) in the outer case 70, and is made of a translucent or transparent material so that light incident through the protective glass 90 can reach the lower solar cell 9. The upper surface of the first dial 20 includes a first region 21, a second region 22, a third region 23 and a fourth region 24 corresponding to the first, second, third and fourth indicators 110, 120, 130, 140 at the 3-o'clock, 6-o'clock, 9-o'clock and half-4 positions, respectively.

The first, second and third regions 21, 22, 23 are circular, and have shaft holes 21*a*, 22*a*, 23*a* for the rotating shafts of the indication disk 111, small hands 121, 122 and indication disk 131 at their centers, respectively. The fourth region 24 is a rectangular opening. At the center of the first dial 20, a shaft hole 26 for the rotating shaft 19 of the hands 5 is provided.

The first region 21 has a striped pattern 21*b* for emphasizing the mark of the currently selected mode in a 60-degree fan-shaped subregion centered at the shaft hole 21*a* and placed on the 3-o'clock side. All of the third region 23 has the same pattern. In the second region 22, characters "4," "AM," "8," "12," "16," "PM," "20" and "24" are provided on a circle, and two scales respectively having twenty-four and sixty evenly spaced markings are formed on two outer concentric circles, in the timepiece 1, since the indication disks 111, 131 are transparent, the striped patterns in the first region 21 and third region 23 are visible through these disks from above (the protective glass 90 side), However, these patterns may be omitted, and the indication disks 111, 131 may be opaque.

In an upper region (on the 12-o'clock side) of the first dial 20, character strings "RX-TMF" (obtaining time information), "NO" (failure in reception), "OK" (success in reception) and "RX-GPS" (obtaining position information) are printed on a 120-degree arc, as indices 25 related to reception of satellite signals. To indicate information on reception, the hands 5 point to one of these indices 25, thereby notifying a user of the corresponding information.

The rim of the first dial 20 is projected and depressed in the radial direction, and includes eight recesses formed by this unevenness. These recesses are disposed asymmetrically with respect to the center line connecting the 12-o'clock and 6-o'clock positions so that the back and front of the first dial 20 can be distinguished based on its uneven shape only. Of these, into four recesses indicated by reference numeral 27, the four projections 18 of the movement 10 are respectively fitted. In other words, the first dial 20 is positioned relative to the movement 10 by a fit between projections and depressions. Into the other four recesses indicated by reference numeral 28, four projections (projections 37 in FIG. 7A described later) of the first dial ring 30 are respectively fitted.

Figure 7A:
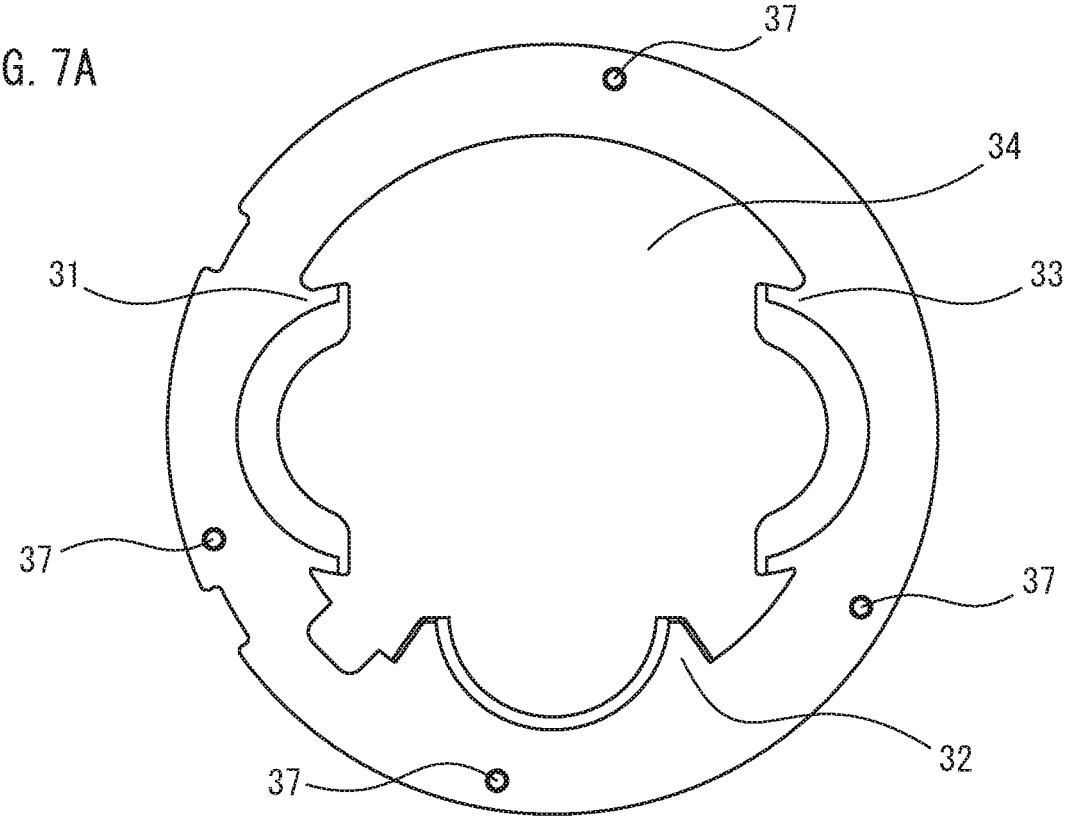
FIGS. 7A and 7B are a back view and a perspective view of the first dial ring 30.
Figure 7B:
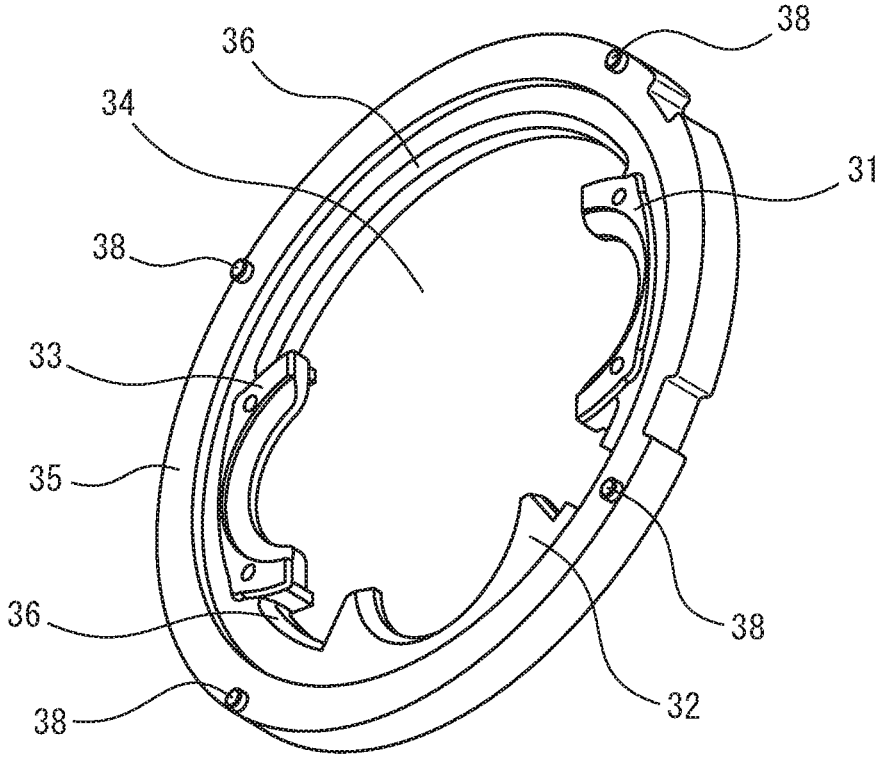

FIGS. 6A to 6E are a top view and cross-sectional views of the first dial ring 30. FIGS. 7A and 7B are a back view and a perspective view of the first dial ring 30. FIGS. 6B to 6E show cross sections of the first dial ring 30 taken along lines VIB-VIB, VIC-VIC, VID-VID and VIE-VIE of FIG. 6A, respectively.

The first dial ring 30 is disposed on an outer portion of the first dial 20, and serves as a decoration of the timepiece 1 and as a spacer filling the space between the first dial 20 and the second dial 40 disposed thereabove to support the second dial 40. The first dial ring 30 includes a first protrusion 31, a second protrusion 32 and a third protrusion 33 corresponding to the first, second and third indicators 110, 120, 130 at the 3-o'clock, 6-o'clock and 9-o'clock positions, respectively. These protrusions have semicircular inclined planes 31*a*, 32*a*, 33*a* along the circles of the first, second and third regions 21, 22, 23 of the first dial 20, respectively, on the sides closer to the center of the first dial ring 30. Each inclined plane is the highest on the outer side, and descends toward the central side, as shown in FIG. 6B.

The central region of the first dial ring 30 indicated by reference numeral 34 is an opening in which the first, second, third and fourth indicators 110, 120, 130, 140 and the rotating shaft 19 are disposed. The edge of the opening 34 also has inclined planes 36 similar to the inclined planes 31*a*, 32*a*, 33*a* except where the first, second and third protrusions 31, 32, 33 exist. Further, the inner rim of the first dial ring 30 has a substantially rectangular recess corresponding to the fourth indicator 140 at the half-4 position.

The first dial ring 30 includes an annular outer portion 35 whose upper and lower surfaces are flat (parallel to each other). The lower and upper surfaces of the outer portion 35 have four projections 37 and four projections 38, respectively, each disposed at intervals of about 90 degrees. The projections 37 may be aligned with the projections 38 in the circumferential direction, but are displaced therefrom in the first dial ring 30. In the top view of FIG. 6A, the positions of the lower projections 37 are also indicated by broken lines so that the positional relationship between the projections 37, 38 can be understood. Each projection 37 is an example of the lower projection, and is fitted into one of the recesses 28 of the first dial 20. In other words, the first dial ring 30 is positioned relative to the first dial 20 by the projections 37. Each projection 38 is an example of the upper projection, and is fitted into one of recesses (recesses 47 in FIG. 8A described later) of the second dial 40.

Figure 8A:
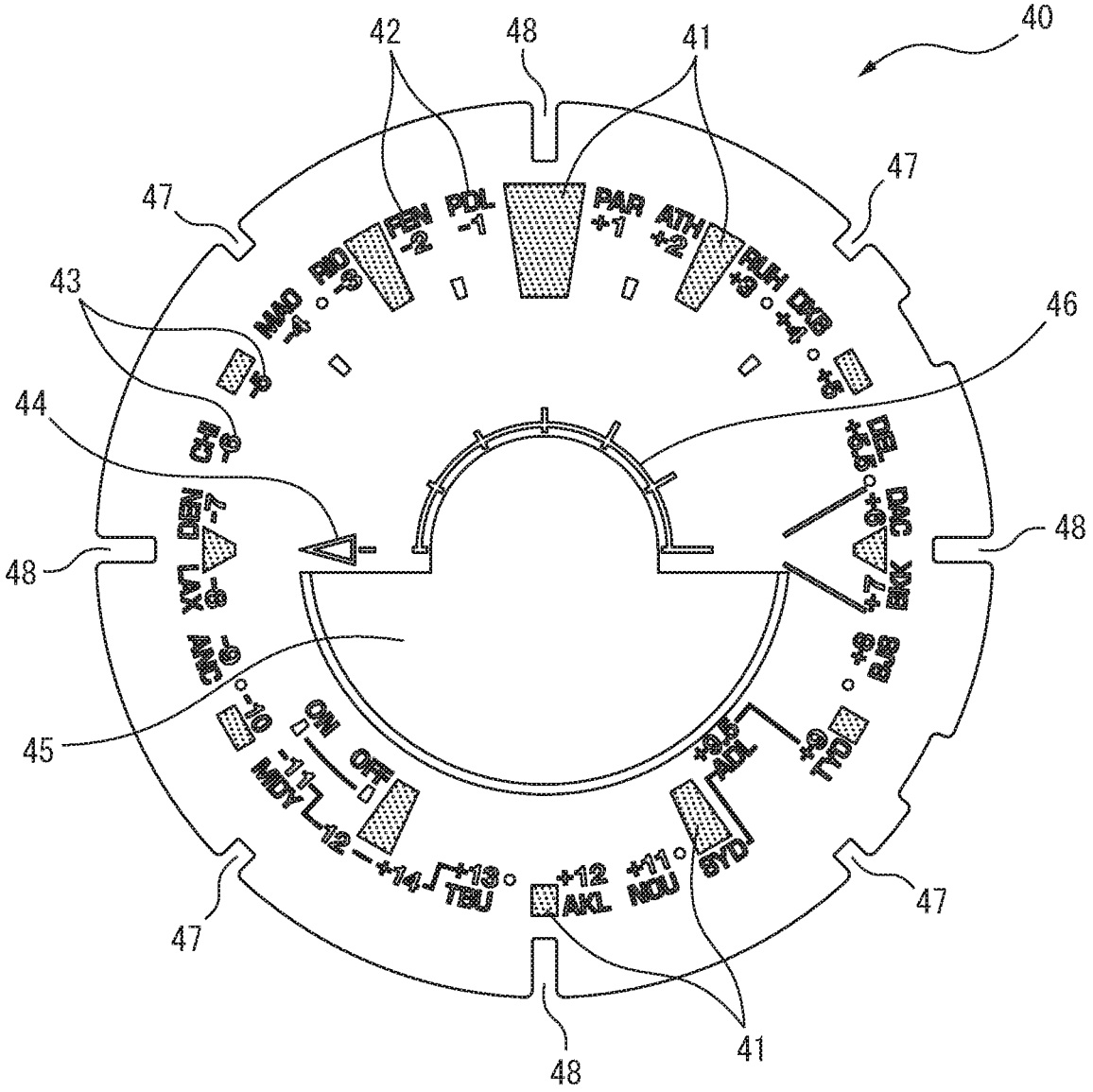
FIGS. 8A and 8B are a top view of the second dial 40 and a cross-sectional view of an index 41.
Figure 8B:
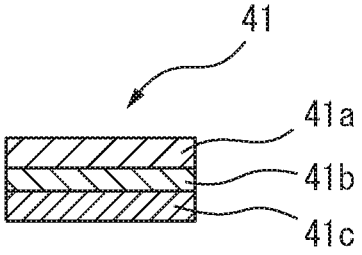

FIGS. 8A and 8B are a top view of the second dial 40 and a cross-sectional view of an index 41. The second dial 40 is a transparent flat member disposed above the first dial 20 with the first dial ring 30 interposed therebetween, and has its outer portion placed on the upper surface of the outer portion 35 of the first dial ring 30, thereby covering almost all the first dial 20. The second dial 40 includes twelve indices 41, city indices 42, time-difference indices 43, a mark 44, an opening 45 and a scale 46.

For the second dial 40, a colored member or a member having a colored layer may be used, as long as it is transparent to such an extent that the first dial 20 is visible. For example, coloring the second dial 40 thin blue or thin orange suggesting the sky or the evening sun allows for producing a visual effect of further emphasizing that the timepiece 1 is a model designed for an aircraft pilot.

The indices 41 are figures for indicating times, and are evenly spaced along the rim of the second dial 40. As shown in FIG. 8B, each index 41 has a three-layer structure composed of a luminous paint 41*a*, a resin film 41*b* and an adhesive layer 41*c*, for example, and is formed by applying the luminous paint 41*a* to the resin film 41*b* and affixing it to the upper surface of the second dial 40 with the adhesive layer 41*c*. In the illustrated example, of the twelve indices 41, the 12-o'clock index is the largest; the 1-o'clock, 5-o'clock, 7-o'clock and 11-o'clock indices are the second largest; and the other indices are smaller. The 3-o'clock and 9-o'clock indices 41 have a substantially triangular shape (pointed trapezoid), while the other indices 41 are rectangular or rectangle-like trapezoidal. In this way, the indices may have different sizes and shapes, and may be displaced in the radial direction from each other. Alternatively, characters, numeral, symbols or protrusions may be formed on the second dial 40 instead of the indices 41.

The luminous paint 41*a* is made, for example, by mixing a resin and decorative particles which are particles of a noctilucent inorganic compound, such as strontium-aluminate phosphor or zinc sulfide, and has the characteristics of glowing in the dark. The indices 41 are not limited to those having the three-layer structure; the luminous paint 41*a* may be directly printed on the second dial 40. Alternatively, instead of luminous paint, a mixture of a resin and decorative particles of a granular material or pigment having reflectivity or glossiness may be used for the indices 41.

In conventional timepieces, indices related to times are made conspicuous, thereby ensuring visibility of time indications. However, in the case of radio-controlled watches, large and conspicuous indices may inhibit reception of radio signals and degrade sensitivity of reception. In the timepiece 1, since the indices 41 are formed on the second dial 40, which is disposed separately above the first dial 20, it is possible to prevent sensitivity of reception from degrading as compared to when the indices are formed on the first dial 20. In the timepiece 1, the 12-o'clock index 41 is disposed immediately above the antenna 14 as can be seen from FIGS. 2, 4 and 8A; however, since the material of the indices 41 is a mixture of a resin and decorative particles, the indices 41 do not inhibit reception of radio signals.

The city indices 42 are abbreviations of cities or regions arrayed on a circle in order of time zones based on the Coordinated Universal Time. Each abbreviation is represented by three characters of the alphabet; these character strings are disposed between the twelve indices 41 on the same circle as the indices 41. The time-difference indices 43 are numerals "−12" to "+14" indicating time differences based on the Coordinated Universal Time for the cities or regions included in the city indices 42, and are disposed on the upper or lower side of the abbreviations. For example, the time indicated by the second indicator 120 in FIG. 1 is the current time of one of the cities or regions included in the city indices 42, and has a time difference relative to the time indicated by the hands 5.

The mark 44 is a triangular mark facing the 9-o'clock index 41, and corresponds to the index of the third indicator 130 in FIG. 1. The opening 45 has a shape of a combination of a larger and smaller semicircles disposed on the 6-o'clock and 12-o'clock sides, respectively, both centered at the center of the second dial 40. The scale 46 is formed along the 12-o'clock-side semicircle of the opening 45, and used for indicating the amount of electric power generated by the solar cell 9 with the hands 5 when the timepiece 1 is in the mode of "LLI" (indicating light quantity of the timepiece). In the scale 46, the 9-o'clock and 3-o'clock positions represent the minimum and maximum of power generation, respectively.

In the timepiece 1, the hour hand 5*h* is disposed below the second dial 40 (between the first dial 20 and second dial 40), as shown in FIGS. 2 and 3. Since a transparent dial has a certain reflectance even if it is transparent, disposing a hand below a transparent dial as described above may reduce visibility of that hand. Superposing two dials may block some of light incident on the solar cell to reduce the efficiency of charging. In the timepiece 1, however, since the second dial 40 has the opening 45, visibility of the hour hand 5*h* is not reduced by the second dial 40, and reduction in efficiency of charging is also prevented as compared to the case without the opening 45.

In the rim of the second dial 40, ten recesses depressed toward the central side are formed. In FIG. 8A, eight of these recesses, except for the two recesses at the 2-o'clock and 4-o'clock positions, are indicated by reference numerals 47, 48. Of these, into the four recesses indicated by reference numeral 47, the four projections 38 of the first dial ring 30 are respectively fitted. In other words, the second dial 40 is positioned relative to the first dial ring 30 by the projections 38. Into the other four recesses indicated by reference numeral 48, four projections (projections 56 in FIGS. 9A to 9C described later) of the second dial ring 50 are respectively fitted.

Figure 9A:
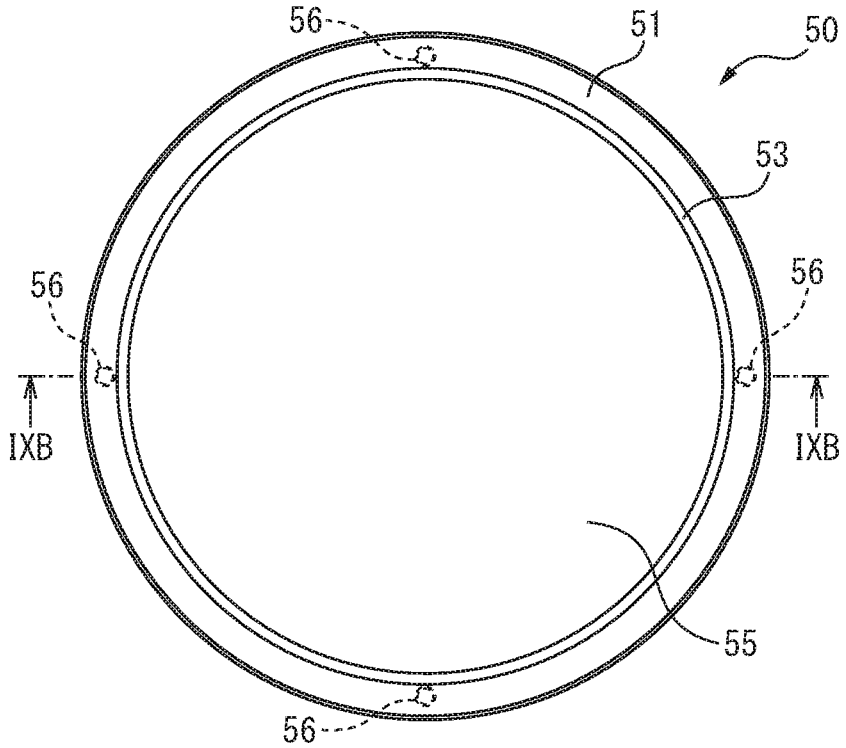
FIGS. 9A to 9C are a top view, a cross-sectional view and a back view of the second dial ring 50.
Figure 9B:
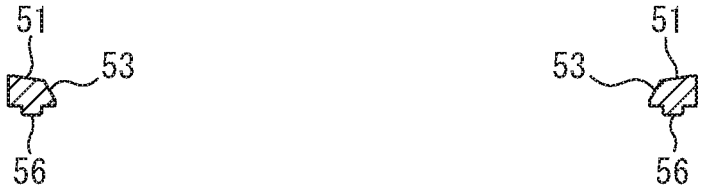
Figure 9C:
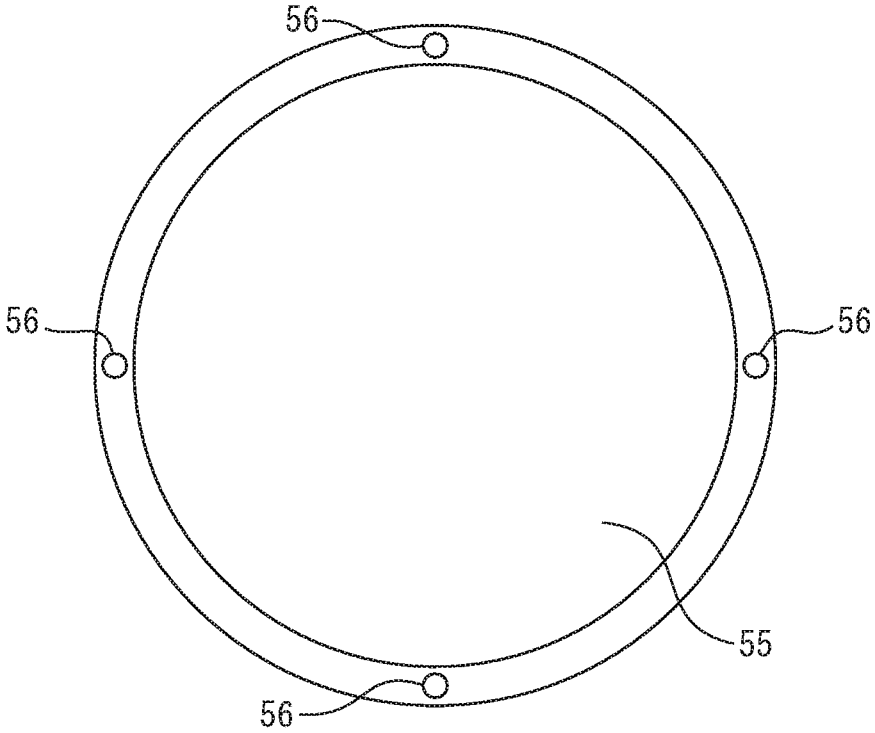

FIGS. 9A to 9C are a top view, a cross-sectional view and a back view of the second dial ring 50. FIG. 9B shows a cross section of the second dial ring 50 taken along line IXB-IXB of FIG. 9A. The second dial ring 50 is disposed on the outer portion of the second dial 40, and serves as a decoration of the timepiece 1 and as one of the scales forming an aviation slide rule. The second dial ring 50 has a circular opening 55 at the center thereof, in which the indices 41, city indices 42, time-difference indices 43, mark 44, opening 45 and scale 46 of the second dial 40 are disposed. On the outer and inner edges of the second dial ring 50, inclined planes 51, 53 having different inclinations are respectively formed. The inclined plane 53 has a larger inclination relative to the horizontal direction (lateral direction in FIG. 9B) and a smaller width in the horizontal direction than the inclined plane 51.

As shown in FIG. 9C, on the lower surface of the second dial ring 50, four projections 56 fitted into the recesses 48 of the second dial 40 are formed at intervals of 90 degrees. In other words, the second dial ring 50 is positioned relative to the second dial 40 by a fit between projections and depressions. In the top view of FIG. 9A, the positions of the projections 56 are also indicated by broken lines.

The second dial ring 50 is disposed on the second dial 40 so as to cover the recesses 47, 48 and the projections 56 fitted into the recesses 48. It is preferred in terms of design to form the second dial ring 50 out of an opaque material and cover these recesses and projections so as not to be visible from above the protective glass 90, since this improves the beauty of the timepiece 1. However, if the fitted portions of the first dial ring 30 and second dial 40 need not be concealed, e.g., if the recesses 48 are provided only on the lower surface of the second dial 40 and the outer portion of the second dial 40 is made opaque, the second dial ring 50 may be omitted.

Figure 10:
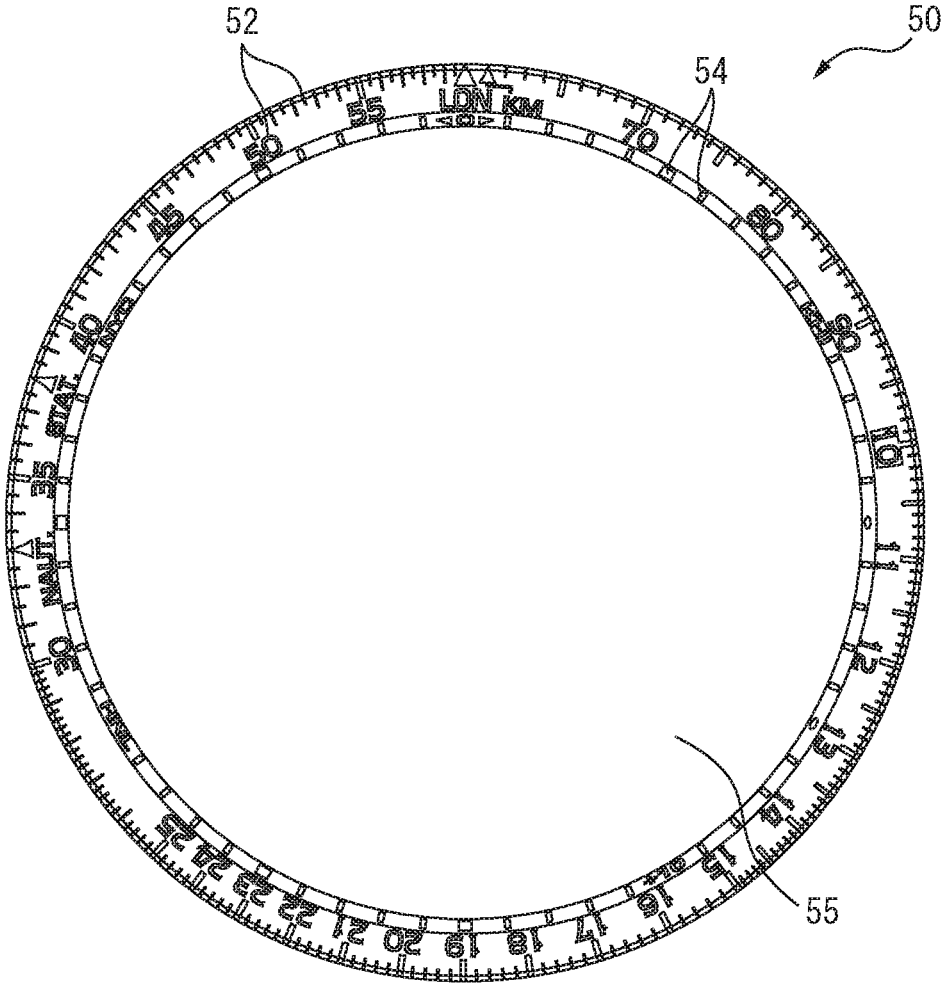
FIG. 10 shows scales 52, 54 of the second dial ring 50.

FIG. 10 shows scales 52, 54 of the second dial ring 50. On the inclined planes 51, 53 of the second dial ring 50, the scales 52, 54 shown in FIG. 10 are respectively formed. On the outer inclined plane 51, numerals "10" to "90" are also printed. The scales 52, 54 are an example of the second scale, and function as an aviation slide rule (circular slide rule) in combination with a scale of the rotating dial ring 60 described below. In FIG. 9A, illustration of the scales 52, 54 is omitted so that the shape of the second dial ring 50 can be understood.

Figure 11A:
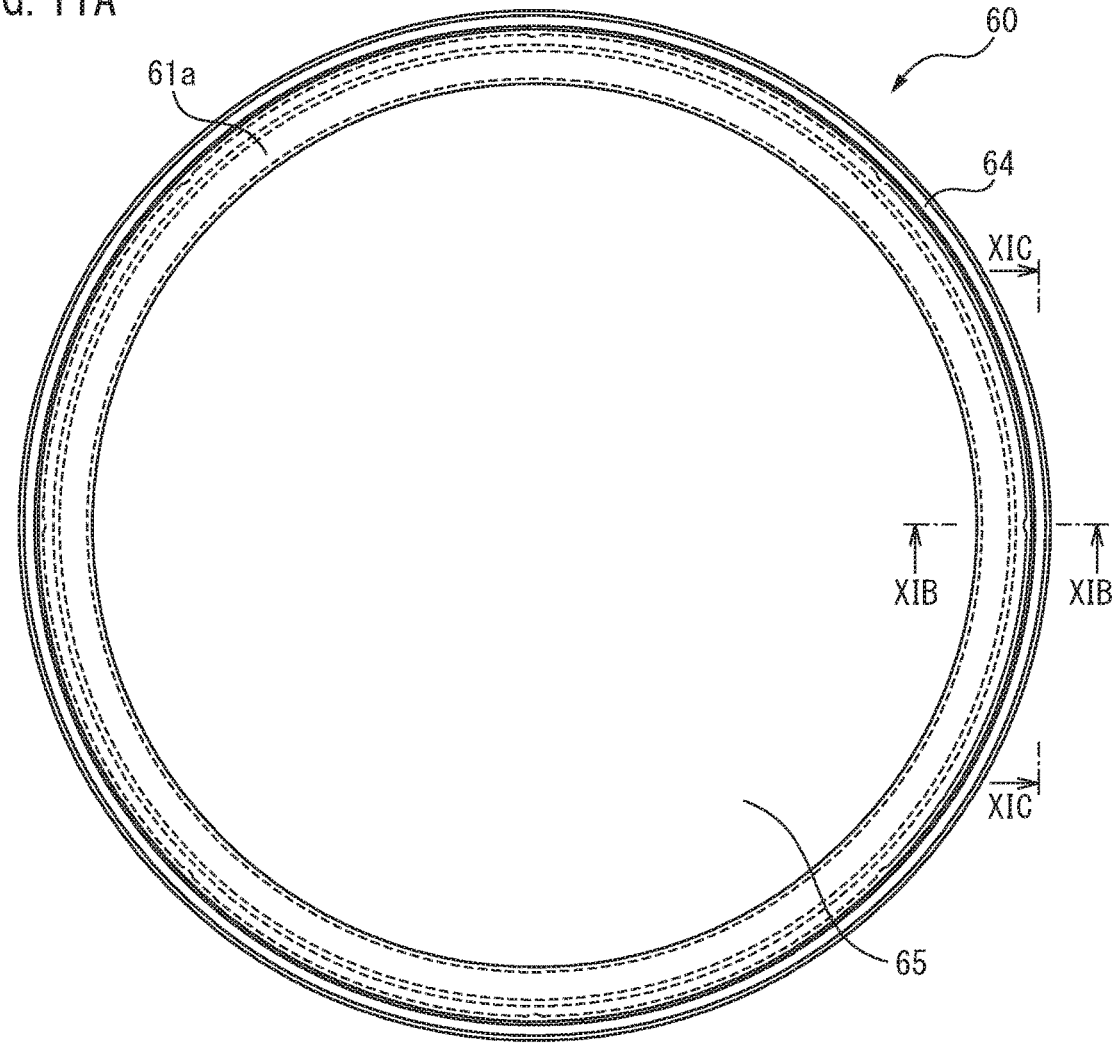
FIGS. 11A to 11C are a top view and cross-sectional views of the rotating dial ring 60.
Figure 11B:
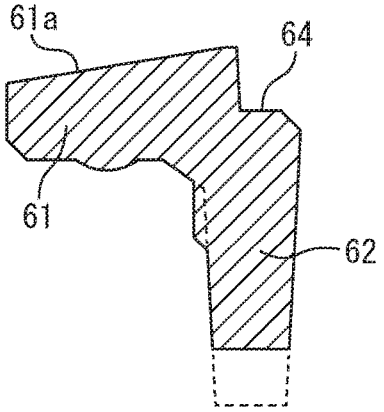
Figure 11C:
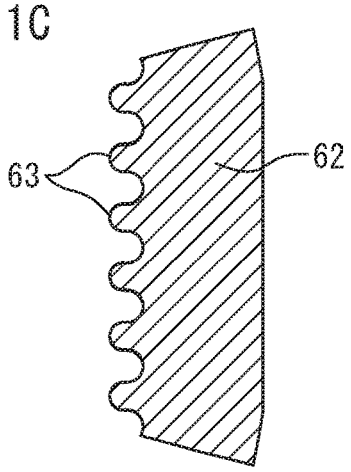

FIGS. 11A to 11C are a top view and cross-sectional views of the rotating dial ring 60. FIGS. 11B and 11C show cross sections of the rotating dial ring 60 taken along lines XIB-XIB and XIC-XIC of FIG. 11A, respectively. The rotating dial ring 60, which is an example of the third dial ring, has a circular opening 65 and is also called an indicator ring. The rotating dial ring 60 is disposed between the second dial ring 50 and the bezel 80 and on the outer case 70 (see FIGS. 2 and 3) so that its inner circumferential surface is in contact with the outer circumferential surface of the second dial ring 50. As shown in FIG. 11B, the rotating dial ring 60 has a substantially L-shaped vertical cross section composed of a horizontal portion 61 and a vertical portion 62 connected together, and has a recess 64 in which a projection of the bezel 80 is housed on the outer side of the joint between the horizontal and vertical portions. The upper surface of the horizontal portion 61 is an inclined plane 61*a* which is lower on the central side of the rotating dial ring 60 than on the outer side.

At the bottom of the vertical portion 62, a gear 63 shown in FIG. 11C is formed all around the rotating dial ring 60. The left and right sides of FIG. 11C correspond to the lower (the movement 10) side and the upper (the protective glass 90) side of the rotating dial ring 60, respectively. The gear 63 is fitted to the second crown 72; the rotating dial ring 60 is rotated around the second dial ring 50 by a user winding the second crown 72.

FIG. 12A shows a scale 66 of the rotating dial ring 60. On the inclined plane 61*a* of the rotating dial ring 60, the scale 66 shown in FIG. 12A is formed and numerals "10" to "90" are also printed. The scale 66 is an example of the first scale, and corresponds to the other scale forming the aviation slide rule (circular slide rule). In FIG. 11A, illustration of the scale 66 is omitted so that the shape of the rotating dial ring 60 can be understood. The aviation slide rule is used to perform simple calculations by appropriately rotating the scale 66 (outer scale) of the rotating dial ring 60 relative to the scales 52, 54 (inner scale) of the second dial ring 50. Since the scales 52, 54, 66 are disposed immediately below the protective glass 90 and placed closest to the user's eyes of the components in the timepiece 1, they are easily visible to the user.

FIG. 12B shows a scale 67 of another rotating dial ring. The scale 67 is different from the scale 66 in FIG. 12A only in that the portion of its markings other than the numerals has a white underlayer; the arrangement of the scale 67 is the same as that of the scale 66. Depending on the design of the timepiece, the scale 67 may be formed on the inclined plane 61*a* of the rotating dial ring 60, instead of the scale 66.

FIGS. 13A and 13B are schematic cross-sectional views for explaining the connection relationship between the movement 10, first dial 20, first dial ring 30, second dial 40 and second dial ring 50. FIG. 13A shows these members assembled together, while FIG. 13B shows the members separated in the vertical direction so that their connection relationship can be understood. As shown in FIG. 13A, the movement 10, first dial 20, first dial ring 30, second dial 40 and second dial ring 50 have substantially the same outer diameter.

As described above, the projections 18 of the movement 10 and the projections 37 on the lower surface of the first dial ring 30 are fitted into the recesses 27 and recesses 28 of the first dial 20, respectively. The projections 38 on the upper surface of the first dial ring 30 and the projections 56 of the second dial ring 50 are fitted into the recesses 47 and recesses 48 of the second dial 40, respectively. In this way, providing the projections 37, 38 on the upper and lower surfaces of the first dial ring 30 and fitting them into the first dial 20 and second dial 40 allows for easily positioning the members, such as the second dial 40.

However, some or all of the projections 18, 37, 38, 56 may not penetrate the first dial 20 or second dial 40 in the thickness direction. In this case, for example, the recesses 27, 28 of the first dial 20 may be left open only in the lower and upper surfaces, respectively. Some or all of the recesses 27, 28, 47, 48 may not be left open on the outer side of the first dial 20 or second dial 40, and may be openings formed in inner regions of these dials. In contrast to the above examples, for example, the first dial 20 and first dial ring 30 may have projections and recesses, respectively; the second dial 40 and second dial ring 50 may have projections and recesses, respectively; and these members may be assembled together by a fit between projections and depressions.

As shown in FIG. 13A, of the hands 5 in the timepiece 1, the hour hand 5*h* is disposed between the first dial 20 and second dial 40, while the minute hand 5*m* and second hand 5*s* are disposed above the second dial 40 (between the second dial 40 and protective glass 90). As shown in FIG. 2, the small hand 121 (and small hand 122) of the second indicator 120 is also disposed between the first dial 20 and second dial 40, and the hour hand 5*h* is displaced from the small hands 121, 122 in the thickness direction between the dials, so as not to come into contact with the small hands. Unlike the illustrated example, the minute hand 5*m* or second hand 5*s* may be disposed between the first dial 20 and second dial 40, and the other hands 5 may be disposed above the second dial 40. Alternatively, for example, two of the hands 5, e.g., the hour hand 5*h* and minute hand 5*m*, may be disposed between the first dial 20 and second dial 40, and the other hand 5 may be disposed above the second dial 40.

Separating the three hands 5 in the thickness direction by the second dial 40 as described above allows for giving the dials a three-dimensional appearance, while making the timepiece thinner as compared to when the three hands 5 are disposed above the second dial 40; accordingly, the appearance of the timepiece 1 is enhanced. Further, in the timepiece 1, visibility of the hands 5 (i.e., of times) is also improved as compared to when the three hands 5 are disposed between the first dial 20 and second dial 40.

The preceding description has been presented only to illustrate and describe embodiments of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A timepiece comprising:

hands being an hour hand, a minute hand and a second hand;

a movement for driving the hands;

a first dial;

a first dial ring having upper and lower surfaces provided with an upper projection and a lower projection, respectively, the first dial ring being disposed on the first dial and positioned relative to the first dial by the lower projection;

a transparent second dial disposed on the first dial ring and positioned relative to the first dial ring by the upper projection;

a second dial ring disposed on the second dial so as to cover the upper projection, the second dial ring being positioned relative to the second dial by a fit between projections and depressions;

a third dial ring having an inner circumferential surface in contact with an outer circumferential surface of the second dial ring, the third dial ring having a first scale on its upper surface and having a gear along its circumference; and a crown fitted to the gear and configured to be operated by a user to rotate the third dial ring, wherein one of the hands is disposed between the first dial and the second dial, while the others of the hands are disposed above the second dial, and the second dial ring has a second scale on its upper surface, the second scale functioning as a circular slide rule in combination with the first scale.

2. The timepiece according to claim 1, wherein the hour hand is disposed between the first dial and the second dial, while the minute hand and the second hand are disposed above the second dial.

3. The timepiece according to claim 1, wherein the first dial is positioned relative to the movement by a fit between projections and depressions.

4. The timepiece according to claim 1, further comprising a small hand for indicating information other than a time indicated by the hands, wherein the small hand is driven by the movement and displaced from the hands in a thickness direction of the timepiece between the first dial and the second dial.

5. The timepiece according to claim 1, wherein the second dial has a central opening through which one of the hands is visible from above the second dial.

6. The timepiece according to claim 1, wherein the second dial has indices for indicating a time, the indices being composed of a mixture of a resin and decorative particles.

7. The timepiece according to claim 6, wherein the decorative particles are particles of a noctilucent inorganic compound.

* * * * *